US006719335B2

(12) United States Patent
Velschou et al.

(10) Patent No.: US 6,719,335 B2
(45) Date of Patent: Apr. 13, 2004

(54) SEAL

(75) Inventors: Jens Velschou, Kokkedal (DK); Preben Michael Remark, Kokkedal (DK)

(73) Assignee: Oneseal A/S, Kokkedal (DK)

( * ) Notice: Subject to any disclaimer, the term of this patent is extended or adjusted under 35 U.S.C. 154(b) by 0 days.

(21) Appl. No.: 10/181,351

(22) PCT Filed: Jan. 15, 2001

(86) PCT No.: PCT/DK01/00026

§ 371 (c)(1),
(2), (4) Date: Sep. 24, 2002

(87) PCT Pub. No.: WO01/54100

PCT Pub. Date: Jul. 26, 2001

(65) Prior Publication Data

US 2003/0075933 A1 Apr. 24, 2003

(30) Foreign Application Priority Data

Jan. 19, 2000 (DK) ..... 2000 00081

(51) Int. Cl.[7] ..... E05C 17/38
(52) U.S. Cl. ..... 292/307 R; 292/325; 292/315
(58) Field of Search ..... 292/307 R, 315, 292/318, 319, 323, 325; 24/136 A, 16 R, 706.8

(56) References Cited

U.S. PATENT DOCUMENTS

| | | | | |
|---|---|---|---|---|
| 3,045,303 A | | 7/1962 | Wade | |
| 3,770,307 A | | 11/1973 | Van Gompel | |
| 3,994,521 A | * | 11/1976 | Van Gompel | 292/319 |
| 4,074,916 A | * | 2/1978 | Schindler | 292/307 R |
| 4,130,686 A | | 12/1978 | Takahashi et al. | |
| 4,344,240 A | * | 8/1982 | Schiller | 40/20 R |
| 4,640,538 A | | 2/1987 | Brammall | |
| 4,681,355 A | | 7/1987 | Brammall et al. | |
| 4,688,302 A | | 8/1987 | Caveney et al. | |
| 4,733,893 A | | 3/1988 | Davis et al. | |
| 4,747,631 A | * | 5/1988 | Loynes et al. | 292/307 R |
| 4,811,978 A | * | 3/1989 | Wu | 292/323 |
| 5,123,686 A | | 6/1992 | Wenk | |
| 5,127,687 A | | 7/1992 | Guiler | |
| 5,337,459 A | | 8/1994 | Hogan | |
| 5,352,003 A | | 10/1994 | Bystry | |
| 5,524,463 A | * | 6/1996 | Schenkel | 70/57.1 |
| 5,647,620 A | * | 7/1997 | Kuenzel | 292/317 |
| 5,765,885 A | | 6/1998 | Netto | |
| 6,131,969 A | * | 10/2000 | Natkins | 292/323 |
| 6,550,830 B2 | * | 4/2003 | Kuenzel | 292/327 |

FOREIGN PATENT DOCUMENTS

| | | |
|---|---|---|
| EP | 0540475 | 5/1993 |
| EP | 0774598 | 5/1997 |
| FR | 2742908 | 6/1997 |

* cited by examiner

*Primary Examiner*—Gary Estremsky
(74) *Attorney, Agent, or Firm*—Dykema Gossett PLLC

(57) ABSTRACT

The invention relates to a lock comprising a housing (5) and a strap (1) that has a first end (2) and a second end (6), said housing (5) comprising: means (4) for securing the first end (2) of the strap (1); an interior cavity (40); a first (7) and a second (8) opening that give access from the exterior to said cavity (40), and allow advancement through the housing (5) of the second end (6) of the strap (1); a first interior, longitudinally extending wall (9) and a second opposed, interior, longitudinally extending wall (10), said walls extending between said first and second openings; a locking device (14) arranged within the cavity (40) between the first (9) and the second (10) walls and that defines a nipping area (45) for securing the second end (6) of the strap (1); and support areas (50) for the strap (1) whereby turning of the strap (1) about its longitudinal axis is prevented. The invention is characterized in that the strap (1) is a string of a plastics material (110) having a polygonal cross section; and that the locking device (14) has a surface that is toothed and/or rough.

27 Claims, 2 Drawing Sheets

SEAL

BACKGROUND OF THE INVENTION

1. Field of the Invention

The present invention relates to a lock as described in the preamble to claim 1 which includes a housing and a pull absorbing strap.

2. The Prior Art

U.S. Pat. No. 4,074,916, incorporated herein by reference, discloses such a lock wherein the strap is constituted by a wire or a cable. In this patent it is described how safety is increased against a person being able to release the lock by pulling the wire while simultaneously the wire is turned or rotated about its longitudinal axis. In this prior art lock, the locking device for the wire is a disc that is—by means of a spring fitted in the cavity between the sidewalls of the housing—pressed against the entry openings for the free end of the wire. Hereby the spring ensures that the disc will always wedge securely in order to tightly nip in the wire it if is attempted to pull out the wire through the entry opening. If, conversely, the wire is pulled in the opposite direction—out through the exit opening for the wire, the spring yields and the wire is able to pass freely. When thus the one end of the wire is secured in the lock housing and the opposite end is pulled through the housing, a closed wire loop is obtained that cannot be opened, but only be tightened. Locks of this type are used for a variety of sealing purposes, e.g., for sealing of large transport containers. Once the lock has been tightened, it cannot be removed unless the wire or the lock is damaged.

The U.S. patent disclosure teaches that, in advance, the wire or the cable has been pressed flat to bring about an oval cross section. Besides the lock housing is provided interiorly with such configuration that said turning or rotation of the wire becomes difficult, the housing along with the disc forming support areas intended to prevent such turning. Albeit the U.S. patent disclosure does not mention the wire configuration in detail, it seems, however, that it is the case of a conventional wire formed by helical winding of a number of metal wires. In order to accomplish said oval cross section, a difficult pressing operation is thus required that uses a complex pressing tool.

It is the object of the present invention to provide an improved lock that is both reliable and inexpensive and that does not presuppose initial flat-pressing of a wire. The lock being a disposable device sold in large numbers, even a minor reduction in the production costs is important, and thus the invention makes it possible to eliminate the need for a complex pressing tool.

SUMMARY OF THE INVENTION

This is obtained by a lock of the kind described above, wherein the strap is a string of a plastics material and having a polygonal cross section. Besides, particularly advantageously the locking device can have a toothed or/and rough surface. This also means that it is possible, in a simple manner, to ascertain visually whether attempts have been made to break the lock, since such attempt will translate into damage to the strap surface. "Polygonal" as used herein designates both a convex and a concave polygon, while it is expected, however, that a string with a convex polygonal cross section will be simpler to manufacture. The string can, in cross section, have sides of equal size and the string can, in cross section, have slightly rounded corners.

The housing and the locking device can, in a conventional manner, be configured as featured in claim 2 where the housing has an interior, sloped wall that forms a guide for the locking device that is preferably configured for being able to roll along this wall.

The support areas of the housing can be formed in a variety of ways, including the way featured in claim 3, by the entry opening for the strap having a cross section that is complementary with the polygonal cross section of the strap. Preferably, in the nipping area for the strap, an interior wall in the housing may be provided with a track shaped in accordance with the cross section of the strap. Advantageously it can be a ridged indentation whereby a portion of the strap can be received in the guide between the wall and the locking device and secured against said turning when the strap is oriented by a nipping force oriented perpendicular to axial direction and exerted by the locking device. It will be understood that in that case the support face of the locking device will constitute a part of the support areas that serve to prevent turning.

Particularly advantageously the strap can be reinforced, eg with fibres that are distributed in the plastics material or by a central, longitudinally extending core of metal that can be manufactured in a conventional manner by twisting of metal wires. In that event the strap can advantageously be manufactured by extrusion.

The entry opening, ie the first opening of the housing, and the exit opening, ie the second opening of the housing, for the strap as featured in claim 10 having particular linear guides for the strap, it is possible to apply to the strap, during its advancement through the cavity within the housing, to a resilient flexing, the upwardly oriented momentum of which urges the strap towards the locking device.

Hereby it is thus ensured that the locking device will, by any movement of the strap towards the entry opening, be firmly wedged between the strap and the sloping wall. Simultaneously it is possible to altogether omit a separate resilient body, the resilient effect of a slightly flexed strap being used to ensure a nipping force between the locking device and the strap. This effect is obtained in the linear guides being, at the entry and/or exit opening (5), oriented towards one surface of the locking device. Hereby it is ensured that the strap cannot pass through the cavity of the housing from the entry opening to the exit opening without having to flex. U.S. Pat. No. 3,770,307 teaches a corresponding solution.

As featured in claim 11 the locking device can conveniently be a substantially circular metal disc or roller with the rough or toothed surface along the circle periphery. Such locking device is extremely simple to manufacture.

In accordance with an embodiment according to claim 12, the linear guide of the entry directs the strap towards a tangent of the locking device and the linear guide of the exit directs the strap towards a chord of the locking device.

In accordance with an embodiment according to claim 13, the lock is particularly simple to manufacture.

Additionally, the lock may conveniently be configured as featured in claim 14. Hereby a high degree of symmetry is accomplished which is advantageous from a technical production point of view and, besides, it is possible for the end user himself to mount the first end of the strap in the lock.

In the following, an embodiment of the lock is described in further detail with reference to the drawings.

DETAILED DESCRIPTION OF THE PREFERRED EMBODIMENT

Figure 1:
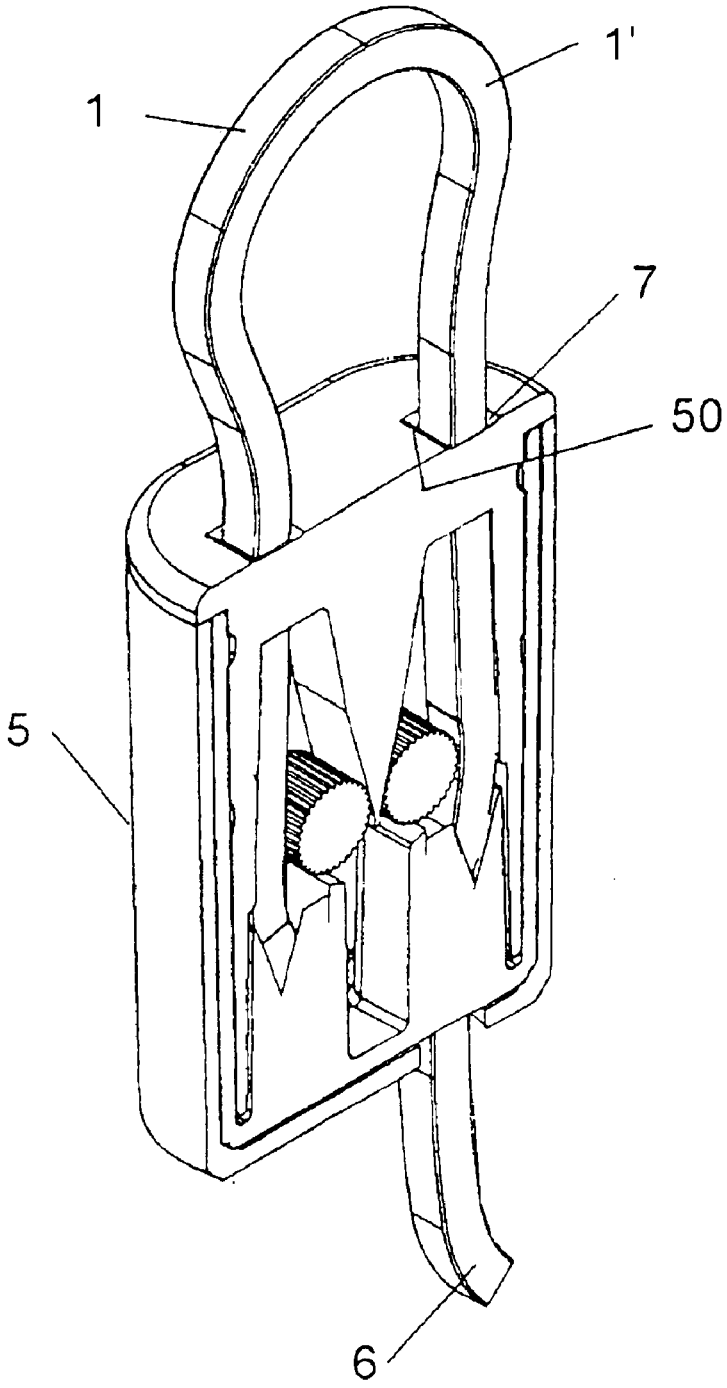
FIG. 1 is a perspective sectional view through a lock according to the invention.

The lock according to the invention comprises a housing 5 and a flexible strap 1. The strap 1 has, as shown (FIG. 2), a first end 2 intended for being conveyed through an entry opening 3 in the housing 5 and for being secured to the housing 5 before the lock is taken into use. In the embodiment shown the securing of the end 2 is accomplished by means of a movable locking device 14', but other means of securing are possible. Thus the first end 2 of the strap 1 can be cast or nipped firmly within the housing 5.

In accordance with the invention shown the strap 1 is a flexible string manufactured from a plastics material, and the strap 1 has—in this example—a square cross section with lateral portions 1'. The strap 1 has a tensile strength that is, during manufacture, adjusted in accordance with the intended use of the lock. The tensile strength can optionally be increased by reinforcing the string, but it is within the scope of the invention to use a string that is made exclusively of plastics.

The opposite end 6 of the strap is conveyed through or around the body (not shown) that is to be secured and through the housing 5 via an entry opening 7 and an exit opening 8. The openings 3, 7 and 8 give, as will appear, access to an interior cavity 40 within the housing 5.

In the cavity 40 there are, between the openings 7 and 8, arranged two walls 9 and 10, of which the wall 9 extends substantially along the longitudinal axis of the housing and in direct extension of the opening 7. The sidewall 10 has a sloping course whereby the distance between the two walls is reduced in a direction towards the opening 7. A disc or roller shaped lock device 14 is situated within the housing 5 between the sidewall 10 and the strap 1, and when it is attempted to pull the strap 1 out through the entry opening 7, the lock device 14 will roll along the wall 10 and wedge firmly between the wall 10 and the strap whereby the further movement of the strap 1 in that direction is prevented.

Both openings 7 and 8 have linear guides for the strap 1, such that the orientation of the strap 1 into the housing is controlled. The linear guide at the opening 7 leads the strap in the longitudinal direction of the housing 5 and along the wall 9, and the linear guide at the opening 8 conveys the strap in the longitudinal direction of the housing, but is slightly offset relative to the entry 7. Thereby the strap is conveyed towards a chord of the locking device 14. In order to pass from the entry opening 7 to the exit opening 8 and around the locking device 14, the strap will have to flex. Such flexing will occur as a consequence of the strap be being resilient. It is noted that this effect can be achieved both by use of the strap of plastics material in accordance with the invention and by use of a wire that is not coated by a plastics jacket.

As mentioned, the locking device 14 is a round disc or roller that has, along its periphery, a toothing or is rough. The resilient abutment of the strap 1 on the periphery of the disc or roller and the rough surface will cause the roller or disc to roll upwards on the face 10, if attempts are made to pull the strap out through the entry opening 7, whereby the strap is wedged firmly against the face 9 due to the sloped course of the face 10. Thereby it is ensured that once it has been conveyed out through the opening 8, the strap cannot be withdrawn. A corresponding mechanism is used to withhold the first end 2 of the strap within the housing. Only in that case there is no exit, but—conversely—a blind hole 18 down into which the strap is conveyed. The linear guides, the sidewalls 9' and 10' at the entry 3, and the locking device 14' are configured in the same manner as was the case with the through-going opening.

In the embodiment shown the housing. 5 comprises a jacket 11 and an insert 12. The insert 12 matches into the jacket 11 and is secured therein by a snap locking connection 13. Conveniently the jacket is made of plastics and the insert of metal or plastics that can optionally be reinforced, but other material combinations are possible. The locking devices 14 and 14' are preferably made of metal. As will appear from the figure, the walls 9 and 10 and the entries 3 and 7 are configured with associated guides for the insert 12, and the jacket forms the exit 8 and the blind hole 18 with associated guides.

FIG. 1 shows a part of the housing 5 at the opening 7. It will appear that in this area the opening 7 is configured with a cross section that is complementary to the cross sectional shape of the strap 1, ie in the case shown preferably with a square cross section and a clearance width that corresponds approximately to the dimensions of the strap 1, whereby turning of the strap 1 about its longitudinal axis outside the housing will not give rise to a corresponding turning of that part of the strap 1 that is situated within the housing 5. The sides 7 of the openings thus form a support area 50 for the strap in this region.

Figure 3:
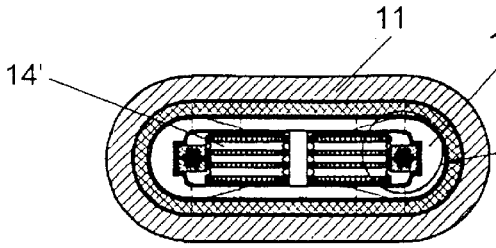
FIG. 3 is a sectional view through the lock along the line B—B in FIG. 2.
Figure 2:
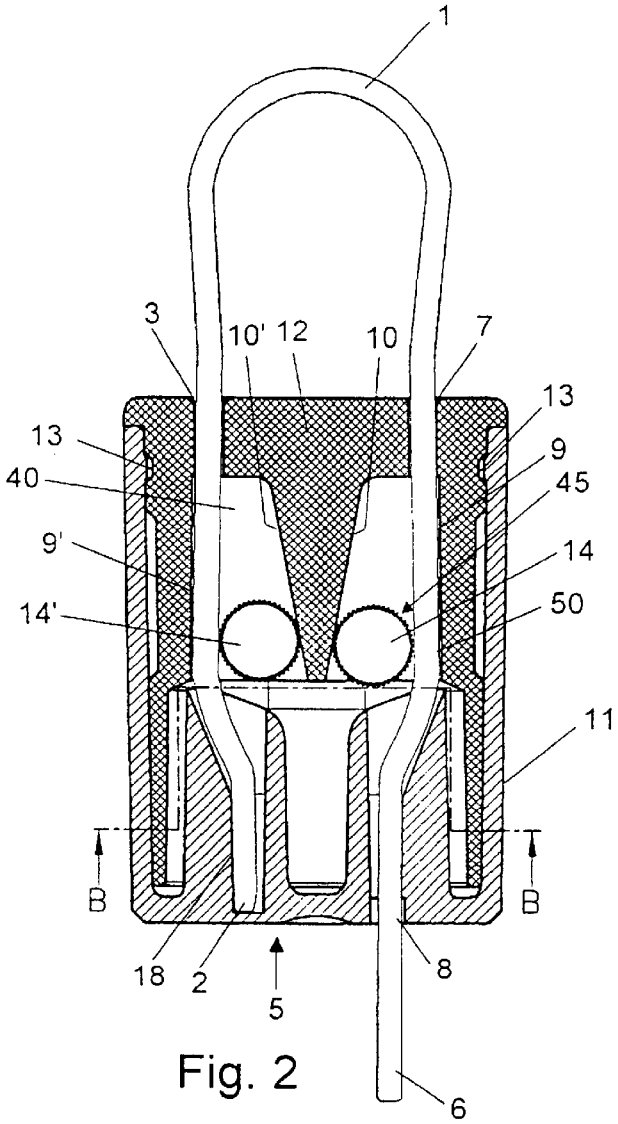
FIG. 2 is a planar sectional view through a central plane in the lock shown in FIG. 1.

Now FIG. 2 shows how the housing 5 can comprise further support areas 50 intended for preventing a rotation of that part of the strap 1 that is situated within the housing 5. More specifically, these support areas are located at the nipping area 45 for the strap 1, ie in the area where the strap 1 can be firmly nipped between the locking device 14 and the wall 9. The support area 50 is in this case defined by the surface of the locking device 14 and by the surface of the wall 9. FIGS. 4*a*–*e* show enlarged sections of FIG. 3 that show a cross section between the housing 5 at the nipping area 45. FIGS. 4*a*–*e* show alternative cross sectional shapes for the strap 1, and it will appear that the strap 1 is configured with a polygonal cross section with preferably three, four, five or six sides. As will appear the strap 1 is configured as a string of a plastics material 110 that is, in the embodiment shown, reinforced with a number of longitudinally extending, twisted metal wires 100.

Figure 4A:
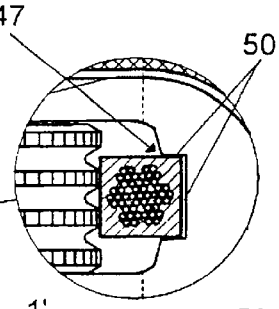
FIGS. 4*a*–4*e* show enlarged sections of FIG. 3.
Figure 4B:
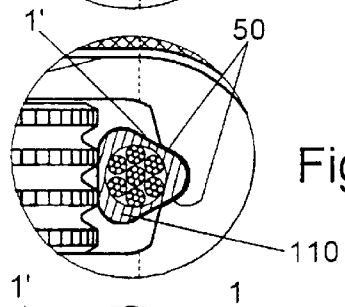
Figure 4C:
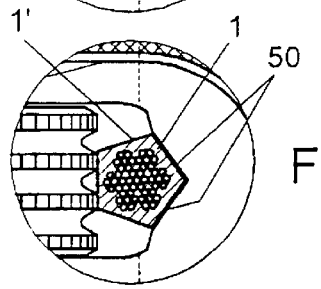
Figure 4D:
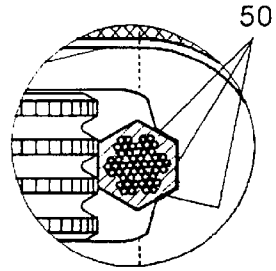
Figure 4E:
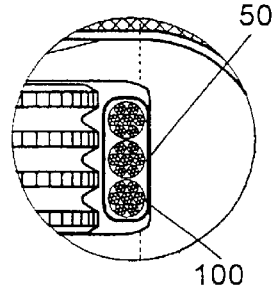

It will appear from FIGS. 4*a*–*d* that the wall 9 can be provided with a track 47 that is dimensioned to be able to receive a portion of the cross section of the strap 1. Preferably the opening 7 is configured such that the strap 1 is automatically aligned to a correct position in order to be receivable in the track 47. Preferably the track 47 has, as will appear, side edges that meet in angles corresponding to the polygonal cross section of the strap 1. However, the track 47 is not an absolute necessity, since the wall 9 may very well be planar as shown in FIG. 4*e*. However, it is of importance that the wall 9 and the locking device 14 are configured and adjusted in accordance with the cross sectional shape of the strap 1 so as to establish support areas 50 that prevent the strap 1 from turning.

What is claimed is:

1. A lock comprising a housing (5) and a strap (1) that has a first end (2) and a second end (6), said housing (5) comprising:

means for securing the first end (2) of the strap (1);

an interior cavity (40);

a first (7) and a second (8) opening allowing advancement through the housing (5) of the second end (6) of the strap (1);

a first interior, longitudinally extending wall (9) and a second opposed, interior, longitudinally extending wall (10), said walls extending between said first and second openings;

a locking device (14) arranged within the cavity (40) between the first wall (9) and the second wall (10) and that defines a nipping area (45) for securing the second end (6) of the strap (1); and support areas (50) for the strap (1) whereby rotation of the strap (1) about its longitudinal axis is prevented, characterized in that the strap (1) is a string of a plastics material (110) having a polygonal cross section and cooperating with said support areas (50) for preventing said rotation, said string of plastics material (110) being internally reinforced, that the strap (1) is manufactured by extrusion, and that the locking device (14) is substantially circular metal disc or roller with a rough or toothed surface arranged along the circle periphery.

2. A lock according to the preceding claim, characterized in that that locking device (14) is configured for being movable in a direction towards the first opening (7); and that the second wall (10) has a sloped course relative to the first wall (9) whereby the distance between the first (9) and the second (10) walls is reduced in a direction towards said first opening (7) thereby defining the nipping area (45) between the first wall (9) and the locking device (14).

3. A lock according to any one of the preceding claims, characterized in that the first opening (7) has a cross section that is complementary with the polygonal cross section of the strap (1) for forming said support areas (50) for preventing axial rotation of the strap (1).

4. A lock according to the preceding claim, characterized in that the first wall (10) is, at least at the nipping area (45), provided with a track (47) that extends along the strap (1) with support areas (50) for the strap (1) in order to combine with a locking device (14) to secure the strap (1) against said axial rotation.

5. A lock according to the preceding claim, characterized in that the track (47) has sidewalls (50) configured for being able to abut on lateral portions (1') of the strap (1).

6. A lock according to claim 1 charaterised in that the first (7) and the second (8) openings have linear guides for the strap (1), the linear guide of the second opening (8) being oriented towards a surface of the locking device (14) whereby the band (1) will, by the advancement through the cavity (40), be exposed to a resilient flexing, the upwardly oriented moment of which pressing the strap (1) towards the locking device (14).

7. A lock according to claim 6 characterised in that the linear guide of the first opening (7) directs the strap along a tangent of the metal disc or roller (14); and the linear guide of the second opening (8) directs the strap towards a chord of the metal disc or roller (14).

8. A lock according to any one of claims 6 or 7, characterized in that the housing (5) comprises a jacket (11) with the second opening (8) and its associated linear guide, and an insert (12) configured for being sealingly displaceable into the jacket (11) and secured therein with a snap-connection (13), said insert (12) inwardly defining the first (9) and the second (10) walls, wherein the insert (12) is—in the end portion that faces away from the jacket (11)—provided with the first opening (7) with its linear guide.

9. A lock according to claim 1, charaterised in that the housing (5) comprises a third opening (3) that gives access to said cavity (40) and allows introduction into the housing (5) of the first end (2) of the strap (1);

that the cavity (40) comprises a third longitudinally extending wall (9) and an opposed fourth, longitudinally extending wall (10), said walls extending from said third opening (3), wherein the fourth wall (10) has a sloping course relative to the third wall (9') whereby the distance between the third (9') and the fourth (10') walls is reduced in a direction towards said third opening 3); and that the means for securing the first end (2) of the strap (1) are in the form of a movable locking device (14') arranged in the cavity (40) between the third (9') and the fourth (10') sidewalls in order to combine with the third wall (9') to define a nipping area for securing the first (2) end of the band (1).

10. A lock comprising a housing (5) and a strap (1) that has a first end (2) and a second end (6), said housing (5) comprising:

means for securing the first end (2) of the strap (1);

an interior cavity (40);

a first (7) and a second (8) opening allowing advancement through the housing (5) of the second end (6) of the strap (1);

a first interior, longitudinally extending wall (9) and a second opposed, interior, longitudinally extending wall (10), said walls extending between said first and second openings;

a locking device (14) arranged within the cavity (40) between the first wall (9) and the second wall (10) and that defines a nipping area (45) for securing the second eng(6) of the strap (1); and support areas (50) for the strap (1) whereby rotation of the strap (1) about its longitudinal axis is prevented, characterized in that the strap (1) is a string of a plastics material (110) having a polygonal cross section and cooperating with said support areas (50) for preventing said rotation, said string of plastics material (110) being internally reinforced by a wire formed by twisted metal wires, that the strap (1) is manufactured by extrusion, and that the locking device (14) is a substantially circular metal disc or roller with a rough or toothed surface arranged along the circle periphery.

11. A lock according to claim 10, characterized in that the locking device (14) is configured for being movable in a direction towards the first opening (7); and that the second wall (10) has a sloped course relative to the first wall (9) whereby the distance between the first (9) and the second (10) walls is reduced in a direction towards said first opening (7) thereby defining the nipping areas (45) between the first wall (9) and the locking device (14).

12. A lock according to claim 10 or 11, characterized in that the first opening (7) has a cross section that is complementary with the polygonal cross section of the strap (1) for forming said support areas (50) for preventing axial rotation of the strap (1).

13. A lock according to claim 12, characterized in that the first wall (10) is, at least at the nipping area (45), provided with a track (47) that extends along the strap (1) with support areas (50) for the strap (1) in order to combine with a locking device (14) to secure the strap (1) against said axial rotation.

14. A lock according to claim 13, characterized in that the track (47) has sidewalls (50) configured for being able to abut on lateral portions (1') of the strap (1).

15. A lock according to claim 10, charaterised in that the first (7) and the second (8) openings have linear guides for the strap (1), the linear guide of the second opening (8) being oriented towards a surface of the locking device (14) whereby the band (1) will, by the advancement through the cavity (40), be exposed to a resilient flexing, the upwardly oriented moment of which pressing the strap (1) towards the locking device (14).

16. A lock according to claim 15, characterised in that the linear guide of the first opening (7) directs the strap along a tangent of the metal disc or roller (14); and the linear guide of the second opening (8) directs the strap towards a chord of the metal disc or roller (14).

17. A lock according to claim 15 or 16, characterized in that the housing (5) comprises a jacket (11) with the second opening (8) and its associated linear guide, and an insert (12) configured for being sealingly displaceable into the jacket (11) and secured therein with a snap-connection (13), said insert (12) inwardly defining the first (9) and the second (10) walls, wherein the insert (12) is—in the end portion that faces away from the jacket (11)—provided with the first opening (7) with its linear guide.

18. A lock according to claim 10, charaterised in that the housing (5) comprises a third opening (3) that gives access to said cavity (40) and allows introduction into the housing (5) of the first end (2) of the strap (1);

that the cavity (40) comprises a third longitudinally extending wall (9) and an opposed fourth, longitudinally extending wall (10), said walls extending from said third opening (3), wherein the fourth wall (10) has a sloping course relative to the third wall (9') whereby the distance between the third (9') and the fourth (10') walls is reduced in a direction towards said third opening 3); and that the means for securing the first end (2) of the strap (1) are in the form of a movable locking device (14') arranged in the cavity (40) between the third (9') and the fourth (10') sidewalls in order to combine with the third wall (9') to define a nipping area for securing the first (2) end of the band (1).

19. A lock comprising a housing (5) and a strap (1) that has a first end (2) and a second end (6), said housing (5) comprising:

means for securing the first end (2) of the strap (1);

an interior cavity (40);

a first (7) and a second (8) opening allowing advancement through the housing (5) of the second end (6) of the strap (1);

a first interior, longitudinally extending wall (9) and a second opposed, interior, longitudinally extending wall (10), said walls extending between said first and second openings;

a locking device (14) arranged within the cavity (40) between the first wall (9) and the second wall (10) and that defines a nipping area (45) for securing the second eng(6) of the strap (1); and support areas (50) for the strap (1) whereby rotation of the strap (1) about its longitudinal axis is prevented, characterized in that the strap (1) is a string of a plastics material (110) having a polygonal cross section and cooperating with said support areas (50) for preventing said rotation, said string of plastics material (110) being internally reinforced by fibres distributed in the plastics material, that the strap (1) is manufactured by extrusion, and that the locking device (14) is a substantially circular metal disc or roller with a rough or toothed surface arranged along the circle periphery.

20. A lock according to claim 19, characterized in that the locking device (14) is configured for being movable in a direction towards the first opening (7); and that the second wall (10) has a sloped course relative to the first wall (9) whereby the distance between the first (9) and the second (10) walls is reduced in a direction towards said first opening (7) thereby defining the nipping areas (45 between the first wall (9) and the locking device (14).

21. A lock according to claim 19 or 20, characterized in that the first opening (7) has a cross section that is complementary with the polygonal cross section of the strap (1) for forming said support areas (50) for preventing axial rotation of the strap (1).

22. A lock according to claim 21, characterized in that the first wall (10) is, at least at the nipping area (45), provided with a track (47) that extends along the strap (1) with support areas (50) for the strap (1) in order to combine with a locking device (14) to secure the strap (1) against said axial rotation.

23. A lock according to claim 22, characterized in that the track (47) has sidewalls (50) configured for being able to abut on lateral portions (1') of the strap (1).

24. A lock according to claim 19, charaterised in that the first (7) and the second (8) openings have linear guides for the strap (1), the linear guide of the second opening (8) being oriented towards a surface of the locking device (14) whereby the band (1) will, by the advancement through the cavity (40), be exposed to a resilient flexing, the upwardly oriented moment of which pressing the strap (1) towards the locking device (14).

25. A lock according to claim 24, characterised in that the linear guide of the first opening (7) directs the strap along a tangent of the metal disc or roller (14); and the linear guide of the second opening (8) directs the strap towards a chord of the metal disc or roller (14).

26. A lock according to claim 24 or 25, characterized in that the housing (5) comprises a jacket (11) with the second opening (8) and its associated linear guide, and an insert (12) configured for being sealingly displaceable into the jacket (11) and secured therein with a snap-connection (13), said insert (12) inwardly defining the first (9) and the second (10) walls, wherein the insert (12) is—in the end portion that faces away from the jacket (11)—provided with the first opening (7) with its linear guide.

27. A lock according to claim 19, charaterised in that the housing (5) comprises a third opening (3) that gives access to said cavity (40) and allows introduction into the housing (5) of the first end (2) of the strap (1);

that the cavity (40) comprises a third longitudinally extending wall (9) and an opposed fourth, longitudinally extending wall (10), said walls extending from said third opening (3), wherein the fourth wall (10) has a sloping course relative to the third wall (9') whereby the distance between the third (9') and the fourth (10') walls is reduced in a direction towards said third opening 3); and that the means for securing the first end (2) of the strap (1) are in the form of a movable locking device (14') arranged in the cavity (40) between the third (9') and the fourth (10') sidewalls in order to combine with the third wall (9') to define a nipping area for securing the first (2) end of the band (1).

* * * * *